US008844604B2

(12) United States Patent
Pelekanos et al.

(10) Patent No.: US 8,844,604 B2
(45) Date of Patent: Sep. 30, 2014

(54) GUIDE ASSEMBLY

(75) Inventors: Stylianos Pelekanos, Sunshine (AU); Louise Helen Page, Sunshine (AU)

(73) Assignee: RMD Industries Pty Ltd., Sunshine, NSW (AU)

( * ) Notice: Subject to any disclaimer, the term of this patent is extended or adjusted under 35 U.S.C. 154(b) by 0 days.

(21) Appl. No.: 13/806,092

(22) PCT Filed: Aug. 3, 2011

(86) PCT No.: PCT/AU2011/000982

§ 371 (c)(1),
(2), (4) Date: Jan. 14, 2013

(87) PCT Pub. No.: WO2012/031313

PCT Pub. Date: Mar. 15, 2012

(65) Prior Publication Data

US 2013/0097807 A1 Apr. 25, 2013

(30) Foreign Application Priority Data

Sep. 9, 2010 (AU) ..... 2010904069

(51) Int. Cl.
*E05D 15/26* (2006.01)
*E05D 15/06* (2006.01)
*E05D 15/16* (2006.01)

(52) U.S. Cl.
CPC ..... *E05D 15/16* (2013.01); *E05D 15/0656* (2013.01); *E05Y 2600/12* (2013.01); *E05Y 2600/14* (2013.01); *E05Y 2600/324* (2013.01); *E05Y 2800/174* (2013.01)
USPC ..... 160/206; 16/87 R

(58) Field of Classification Search
USPC ..... 160/199, 206, 203, 194; 16/87 R, 91, 16/92, 97
IPC ..... E06B 15/264,15/266
See application file for complete search history.

(56) References Cited

U.S. PATENT DOCUMENTS

| | | | | | |
|---|---|---|---|---|---|
| 1,060,132 | A | * | 4/1913 | Schaefer | 160/206 |
| 1,384,763 | A | | 7/1921 | Jordan | |
| 1,499,312 | A | | 6/1924 | Ferris | |
| 1,503,364 | A | | 7/1924 | Howat | |
| 1,545,565 | A | | 7/1925 | Lang | |
| 2,937,398 | A | * | 5/1960 | Latham | 16/95 R |
| 3,285,324 | A | * | 11/1966 | Stein et al. | 160/206 |
| 3,554,267 | A | * | 1/1971 | Brinker | 160/118 |
| 3,793,673 | A | * | 2/1974 | Lawrence, Jr. | 16/97 |
| 3,829,930 | A | * | 8/1974 | McNinch | 16/105 |
| 5,085,262 | A | * | 2/1992 | Tutikawa | 160/199 |

OTHER PUBLICATIONS

International Search Report and Written Opinion of PCT/AU2011/000982 mailed on Jul. 10, 2011, 11 pages.

* cited by examiner

*Primary Examiner* — David Purol
(74) *Attorney, Agent, or Firm* — Kilpatrick Townsend & Stockton LLP

(57) ABSTRACT

A guide assembly for a folding panel assembly or system, the guide assembly including a first body section for locating the assembly in a guide channel and a second body section for carrying a bolt that passes through a hinge for attachment to a folding panel, wherein the second body section is pivotally mounted to the first body section so as to adopt either a left or right handed orientation relative to the first body section.

10 Claims, 10 Drawing Sheets

GUIDE ASSEMBLY

RELATED APPLICATIONS

This application claims priority from Australian Patent Application No. 2010904069, the contents of which are incorporated herein by reference.

FIELD OF THE INVENTION

The invention generally relates to guide assemblies for use with sliding door systems. The expression "sliding door systems" in this patent specification includes within its scope all types of folding panels including doors, windows and the like, concertinaed panels, bi-fold systems and the like.

BACKGROUND OF THE INVENTION

Conventional concertinaed folding panels such as folding door or window systems typically include a top hanger below which the panel is suspended and a bottom guide coupled to the bottom of the door. To allow panels to slide between an open and closed position the top hanger and the bottom guide may include roller bearings which are located within a corresponding upper track and lower channel, respectively. To enable the panels to pivotally open inwardly or outwardly, the top hanger and the bottom guide may also include vertically oriented hanger and guide bolts, respectively.

On the lower end of the last panel that is the panel remote from the frame to which the system is attached, for example the fourth door panel, the guide is in the form of an end guide. The end guide is configured to retain the bottom of the panel in the lower channel.

Typically, the end guide comprises a guide body with two roller bearings connected to the body to allow the end guide to roll within the channel and has a guide bolt extending therefrom.

Folding panel assemblies, such as a folding door system generally operate from either right to left or left to right. In use, the end guide is generally located under the panel so that the panel can close flush upon a jamb frame or another meeting panel. This arrangement leads to the guide body for the end guide being either suitable for left handed or right handed use.

A disadvantage of these types of end guides is that the need for two types of guides makes the components confusing for customers when ordering. Further, the end guide can not be reconfigured for reverse use.

Guide bolts are generally used to connect hinges associated with the sliding panels to the end guides. Known end guides typically include a threaded bore provided in the casting into which a threaded bolt is coupled. During the life cycle of the product, guide bolts may unwind themselves due to vibration in the system. Such guide bolts typically have a "HEX" profile or drive on the bolt's head so the bolt can be wound in and out of the body. The head of the guide bolt is also visible on the external side of the closed door system.

A disadvantage of these types of couplings between the guide bolts and the end guide is that the end guide may become disconnected from the guide bolt and hence the folding panel system. Furthermore, the bolt can easily be removed and has a visible "HEX" drive on its head which can make the door vulnerable to break-in.

SUMMARY OF THE INVENTION

In accordance with the present invention, there is provided a guide assembly for a folding panel assembly or system, the guide assembly including a first body section for locating the assembly in a guide channel and a second body section for carrying a bolt that passes through a hinge for attachment to a folding panel, wherein the second body section is pivotally mounted to the first body section so as to adopt either a left or right handed orientation relative to the first body section.

In another aspect there is provided a guide assembly for a folding door system, the guide assembly including a first body section and a second body section, the second body section being operatively connected to the first body section such that in one mode it is displaceable relative to the first body section, the second body section including a bolt support portion which can be oriented in different positions relative the first body section as a result of the relative displacement.

In one form when the guide assembly is in the aforementioned one mode the second body section is rotatable relative the first body section to effect said relative displacement.

In one form the first and second body sections may have cooperating mountings which when in the aforementioned one mode permit the relative rotation about a rotation axis, the bolt support portion being spaced from the axis of rotation. In one form the cooperating mountings may comprise a socket and an insert.

The guide assembly may in one form further include a locking device movable between a lock position in which relative displacement between the first and second body sections is inhibited and a release position in which the relative displacement can be effected.

In one form the first body section comprises an elongated member, the mounting being in the form of a socket at one end thereof, the second body section comprising an arm with the mounting in the form of an insert at one end thereof and the bolt support being at the other end thereof. The bolt support may comprise a socket for receiving an end of a guide bolt therein.

In one form the locking device comprises a fastener mounted to the first body section and movable in direction laterally with respect to the rotation axis between the release and lock positions. In one form, when in the lock position the fastener extends into an aperture in the insert thereby inhibiting rotation of the insert. The fastener may include a threaded portion which cooperates with a threaded portion on the first body section so that rotation of the fastener causes movement thereof between the release and lock positions.

In one form the guide may further include rollers operatively mounted to the first body section. In one form the insert may include an axle projecting from an end thereof to which one of the rollers is operatively mounted.

BRIEF DESCRIPTION OF THE DRAWINGS

The invention is described, by way of non-limiting example only, by reference to the accompanying drawings, in which.

DETAILED DESCRIPTION OF THE INVENTION

Figure 1A:
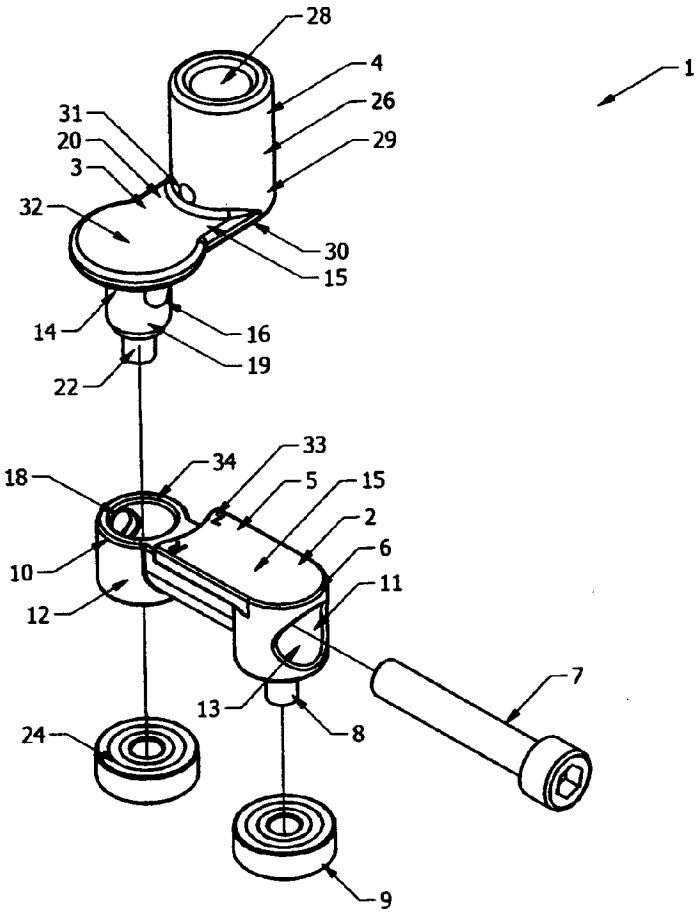
FIG. 1*a* illustrates a perspective exploded parts view of the guide assembly.
Figure 1B:
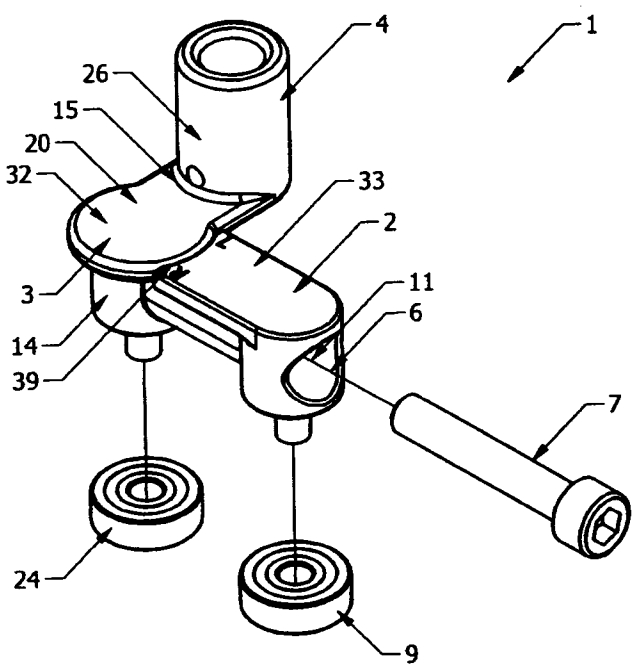
FIG. 1*b* illustrates another perspective exploded parts view of the guide assembly with the first and second body placed together.
Figure 1C:
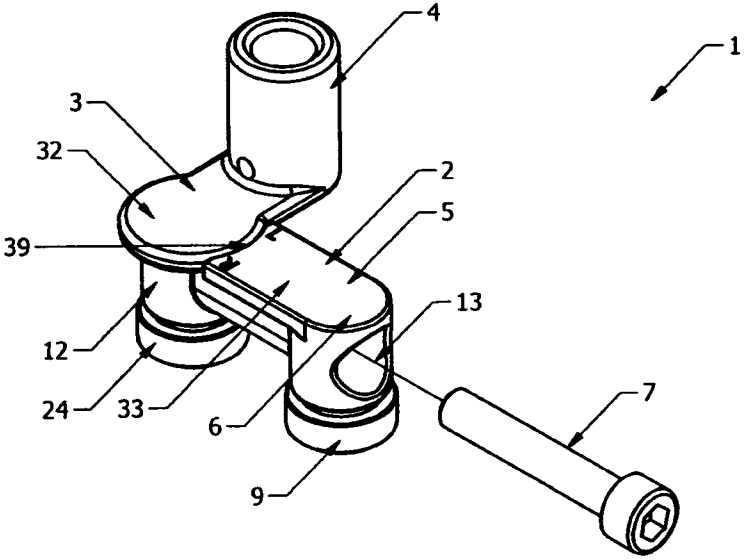
FIG. 1*c* illustrates a perspective view of the guide assembly with a guide bolt removed.

Referring to FIGS. 1*a* to 1*c* there is illustrated a guide assembly 1 for use in a folding door system (not shown), the guide assembly 1 including a first body section 2 releasably secured to a second body section 3. The second body section 3 includes a guide bolt support portion or collar 4 for receiving therein an end of a guide bolt 35 shown, for example, in FIG. 2*a*.

The first body section 2 is in the form of an elongate member 5 with a first end 6 and a second end 10. The first end 6 includes an axle 8 onto which a bearing wheel or roller 9 can be mounted, the wheel 9 being rotatable to allow the assembly 1 friction reduced passage through a channel (not shown) when in use with a folding door system or similar.

The elongate member 5 includes a central bore 11 which extends from the first end 6 to the second end 10. The central bore 11 includes a mouth portion 13 located at the first end which is able to receive the head of a fastener 7 and a narrower portion towards the second end 10 which receives the shank of the fastener 7. The second end 10 includes a socket or cylindrical housing 12 which has a central axis which intersects with the central axis of the central bore 11.

The second body section 3 is in the form of an arm 20 extending between an end 14 and an opposing end 26. The end portion 14 of the second body 3 includes an insert 19 extending to one side of the arm 20 of the second body section 3. The insert 19 has an outer surface configured to be rotatably seated in the socket or cylindrical housing 12. A through hole 16 is provided in the insert through which the fastener is able to pass.

In this configuration, the fastener 7 is able to pass through the cylindrical housing 12 such that when the insert 19 of the second body section 3 is received within the socket or cylindrical housing 12, the fastener passes through a hole 16 located on the end portion 14 and is secured to an end bore 18 by a threaded coupling of the fastener 7 and the end bore 18.

Extending from the insert 19 is a concentrically arranged second axle 22 onto which a second bearing in the form of a wheel or roller 24 is able to be mounted. The bearing 24 serves to hold the first and second body sections 2, 3 together during free rotation therebetween, as a bolt axis is rotated about the first body section 2. The second axle 22 is aligned with the axle 8 such that wheel bearings or rollers 9, 24 are aligned.

The opposing end 26 of the arm 20 includes the guide bolt support portion 4 which extends in an opposing direction to the insert 19. More specifically, the support 4 is a generally cylindrical socket or collar with an upper circular entrance 28 and a lower portion 29 with an asymmetric internal profile in the form of a D shaped hole 30. The support 4 includes a side bore 31.

Figure 2A:
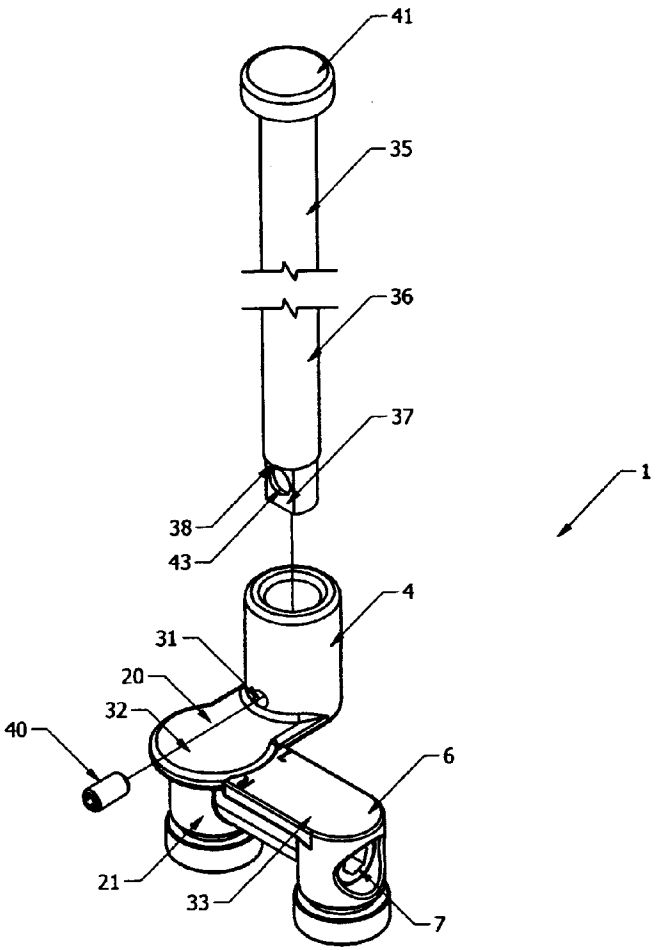
FIG. 2*a* illustrates a perspective view of the guide assembly with a guide bolt and lug removed.
Figure 2B:
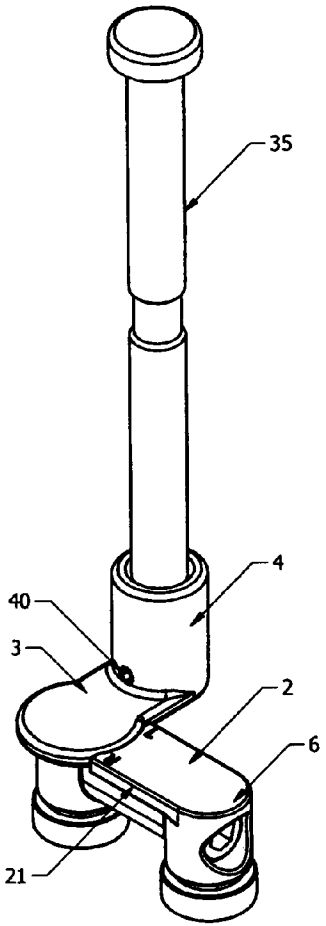
FIG. 2*b* illustrates a perspective view of the guide assembly with the end bolt and lug coupled thereto.

It will be appreciated that the fastener 7 is able to releasably secure the first body 2 relative the second body 3 such that when the fastener 7 is moved to a release position where the second body section 3 is able to be rotated and/or be repositioned relative the first body section 2. When the fastener 7 is moved into a lock position it is located in the central bore 11 and passes through the hole 16 of the end portion 14, the first body section 2 and the second body 3 become coupled together. Referring additionally to FIGS. 2*a* and 2*b*, the guide assembly 1 is shown with the fastener 7 passing through the central bore 11, the hole 16 and the end bore 18 to secure the first body 2 and the second body 3 together.

A top surface 33 of the elongate member 5 has a recessed section 34 (best appreciated in FIG. 1*a*) towards the second end 10 into which a top surface 32 of the arm 20 is able to be received such that the top surfaces 32 and 33 are generally aligned. Accordingly, it will be appreciated that the arm 20 and the elongate casting 5 present generally planar top surfaces 32 and 33, respectively.

Moreover, the junction 39 the top surface 33 of the elongate casting 5 is curved to correspond with the top surface 32 of the arm 20. Accordingly, is the released mode or condition, with the fastener disengaged, the first body 2 may be rotated relative the second body 3 without removing the round body portion 19 of the end portion 14 from the cylindrical housing 12 of the first body 2.

Referring to FIGS. 2*a* and 2*b*, it may be appreciated that when in an engaged mode or condition the first body section 2 and the second body section 3 provide an arrangement in which a guide bolt 35 is able to be received and supported. The guide bolt 35 includes an elongate shank 36 extending from a head 41. The lower portion of the elongate shank 36 includes a flat section 37. The flat section 37 is configured to engage with the D-shaped bore 30 to restrict the guide bolt 35 from rotation when the guide bolt 35 is inserted into the bolt support, the flat section 37 being of a lesser diameter than the elongate shank 36 such that shoulders 38 are provided. When the guide bolt 35 is inserted into the bore 30, the shoulders prevent the guide bolt 35 from passing entirely through the cylindrical housing 12.

The guide bolt 35 includes a side bore 43 which, when the guide bolt 35 is inserted into the bolt receiving portion 4 is configured to correspond to the side bore 31. A threaded lug 40 is then fastened through the side bores 31 and 43, the lug 40 securing the guide bolt 35 to the bolt receiving portion 4.

It may be appreciated that the guide bolt 35 is restricted from axial rotation by the coupling of the asymmetric profile of the D-shaped bore 30 and the corresponding flat section 37 and profile of the bolt 35. Accordingly, unlike guide bolts which include a threaded coupling between the guide bolt 35 and the guide assembly 1, in this arrangement the guide bolt 35 generally does not rotate and is less likely to work itself loose during operation such as, for example, when the guide assembly 1 and guide bolt 35 are used in conjunction with a folding door system. Furthermore, as the guide bolt 35 is not threaded, the head 41 does not include a recessed portion to receive and couple with a screw driver, key or the like.

Therefore, it may be appreciated the guide bolt 35 and guide assembly 1 provided herein has increased security compared to known systems where the head of a guide bolt or similar may have a recessed portion to receive and couple with a screw driver, key or the like. Furthermore, the vertical axial movement of the guide bolt 35 is restricted by the threaded lug 40 which passes though the side bores 31 and 43. Due to the configuration of the D-shaped bore 30 and the flat section 37, the lug 40 is able to be relatively small and positioned such that when the guide assembly 1 and the guide bolt 35 are used with a folding door system or similar the lug 40 can only be accessed when the folding doors are open which reduces the security threat.

Referring now to FIGS. 3*a* to 3*d*, the guide assembly 1 is illustrated as being moved from a left hand orientation to a right hand orientation. To indicate the orientation of the first body 2 relative the second body 3 the top surface 32 of the arm 20 includes the letters "L" and "R" on opposing sides. The left hand orientation is indicated with an "L" located closest to the first end 6, while the right hand orientation is indicated with an "R" located closest to the first end 6.

Figure 3A:
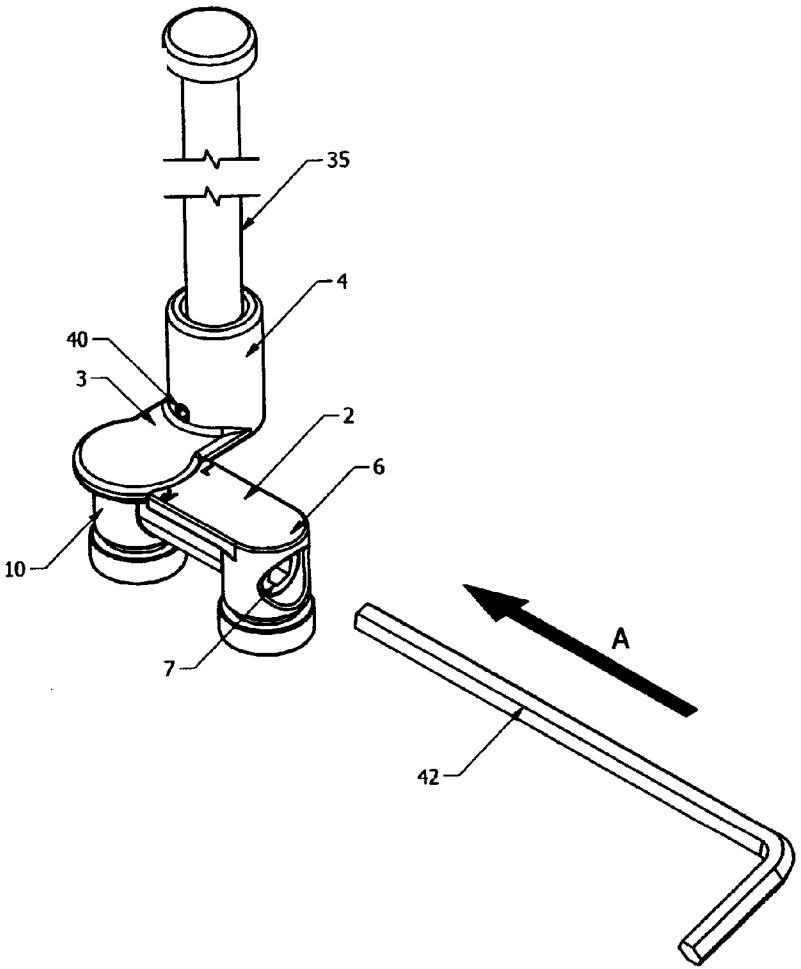
FIGS. 3*a* to 3*d* illustrate the process of actuating the guide assembly with the end bolt secured thereto between a left handed configuration and a right handed configuration.
Figure 3B:
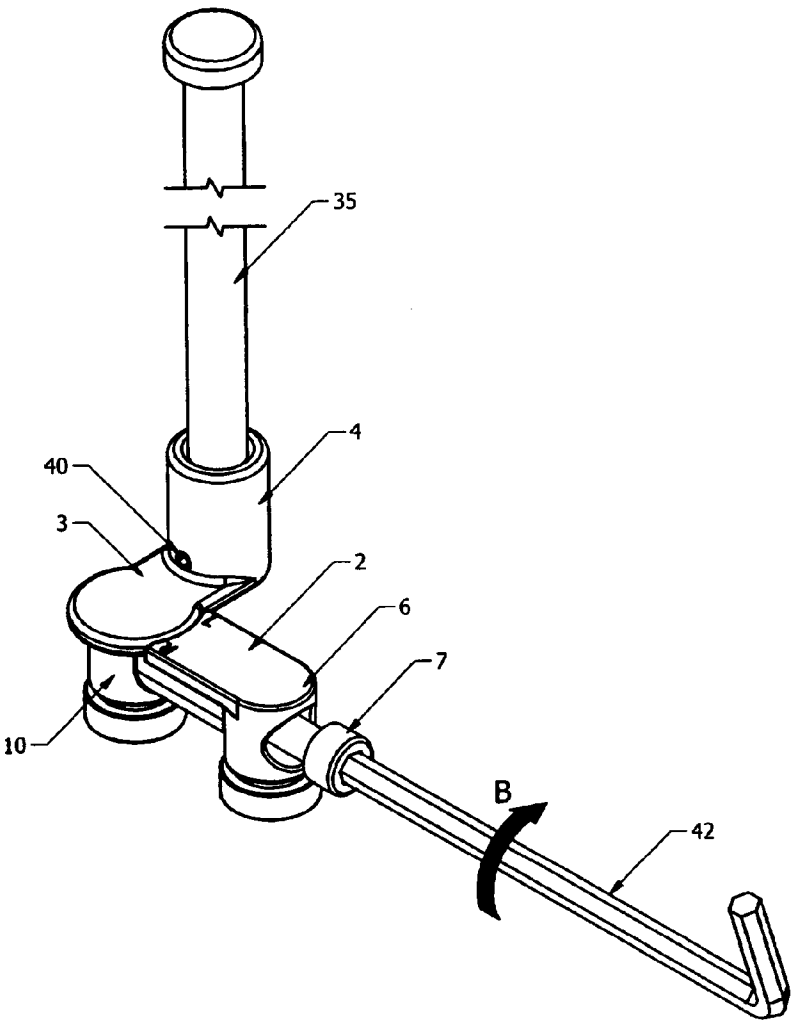
Figure 3C:
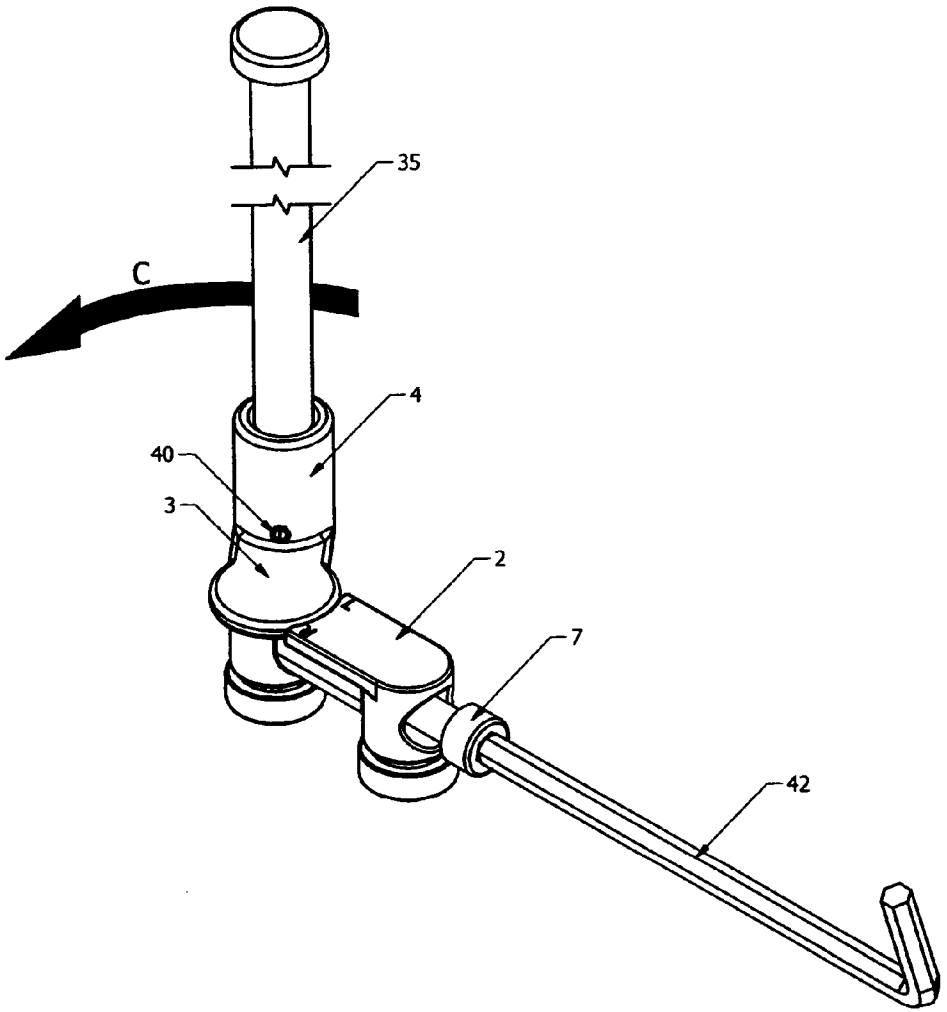
Figure 3D:
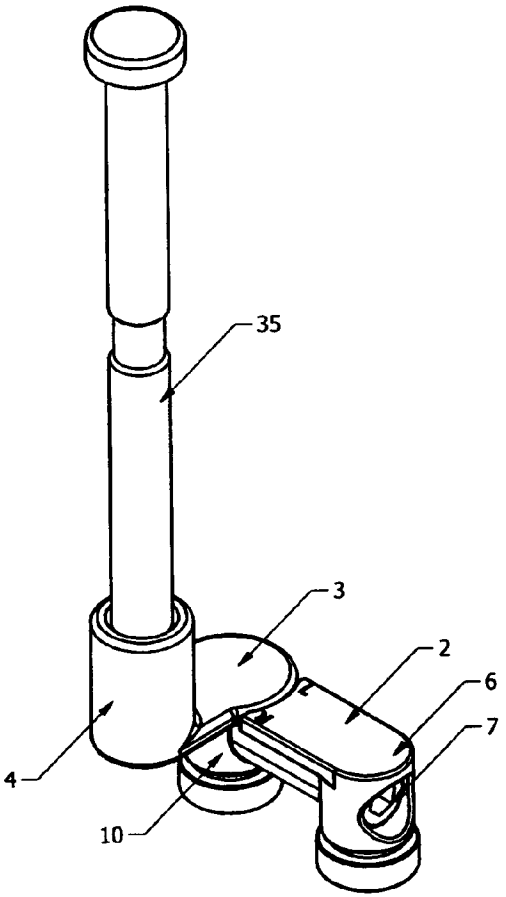

Beginning at FIG. 3*a* the guide assembly is shown in an engaged condition in a left hand orientation with the guide bolt 35 secured in place and the fastener 7 securing the first body 2 to the second body 3. A key 42 is shown which may be engaged with the head of the fastener 7, as indicated by arrow "A" and rotated in the direction of arrow "B" to loosen the fastener 7 as is shown in FIG. 3*b*. Once the fastener is loosened, the second body 3 may be freely rotated in the direction indicated by arrow "C", whilst still being held to the first body section 2 by the bearing wheel 24. Accordingly, the arm 20 is rotated through approximately 180, such that the letter "R" is moved closest to the first end 6 as is illustrate in 3*d*. The fastener 7 is then inserted through the hole 16 of the end portion 14 and secured into the end bore 18 to secure the first body 3 to the second body 3.

As may be appreciated from FIGS. 3*a* to 3*d* the guide assembly provides an ambidextrous fitting with minimal parts and clear labels (the letter "L" and "R") which allows the guide assembly to be simple to reconfigure between a left handed and a right handed orientation. Furthermore, advantageously the coupling of the guide bolt 35 and the second body 3 is such that the guide bolt 35 does not generally rotate and therefore does not tend to work loose during use. Moreover, the lug 40 associated with the guide bolt 35 is not easily visible and therefore does not provide an easy visible access means to remove the guide bolt 35 from the guide assembly hence providing a security advantage when used with a folding door system or similar.

Figure 4:
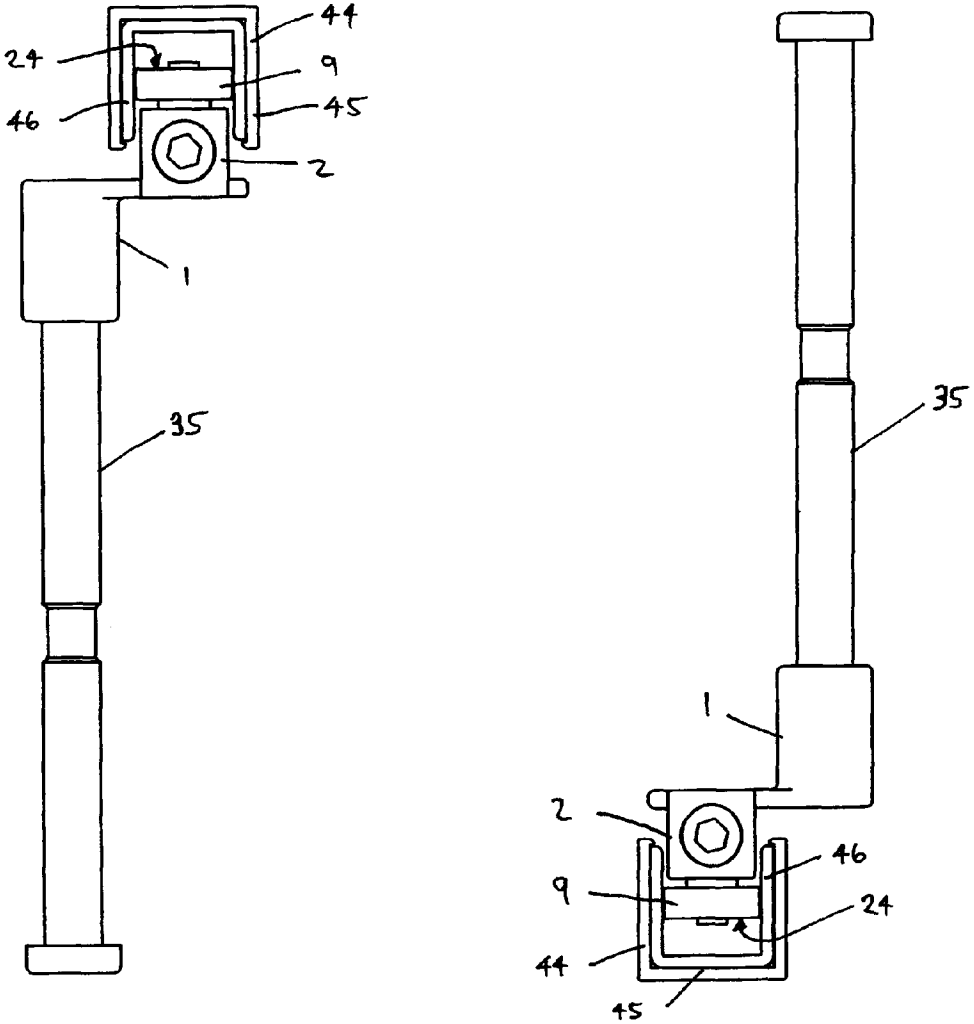
FIG. 4 illustrates the guide assembly in a channel which is installed to the still base or the headboard, depending on the application.

With reference now to FIG. 4, the guide assembly 1 is shown in an in use environment, with the first body portion 2 and bearing wheels 9, 24 in a channel 44. In the example shown, the channel 44 is formed of an aluminum extrusion 45 with a polypropylene channel 46 inserted, although other suitable channel structures can instead by used, as appropriate. As illustrated in FIG. 4, the guide assembly 1 can be used in both top hung and bottom folding applications—the channel 44 is either installed to the sill base or the headboard depending on the application.

Many modifications will be apparent to those skilled in the art without departing from the scope of the present invention.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

LIST OF PARTS

1. Guide assembly
2. First body
3. Second body
4. Bolt support portion
5. Elongate body
6. First end
7. Fastener
8. Axle
9. Bearing wheel or roller
10. Second end
11. Central bore
12. Socket or cylindrical housing
13. Mouth portion
14. Insert
15. Casting
16. Hole
18. End bore
19. Body portion
20. Arm
22. Second axle
24. Second bearing or wheel
26. Opposing end portion
28. Circular entrance
29. Lower portion
30. D-shaped hole
31. Side bore
32. Top surface
33. Top surface
34. Recessed section
35. Guide bolt
36. Elongate shank
37. Flat section
38. Shoulder
39. Junction
40. Lug
41. Head
42. Key
43. Side bore
44. Channel
45. Extrusion
46. Channel

The invention claimed is:

1. A guide assembly for guiding a folding panel along a guide channel, including:

a first section with an elongate body configured for lengthwise insertion and travel in the guide channel;

a second section pivotally coupled to the first section, with an arm that has a bolt support portion to hold a bolt that attaches to the folding panel, the arm being able to swing between:

a left handed orientation relative to the first section, to position the bolt support portion to one side of the guide channel when the elongate body is inserted in the guide channel; and a right handed orientation relative to the first section, to position the bolt support portion to the same side of the guide channel when the elongate body is inserted lengthwise in the guide channel in a reverse orientation; and a fastener to lock the second section against rotation relative to the first section and thereby fix the arm in either the left or right handed orientation.

2. The guide assembly of claim 1, wherein the second section is coupled into the first section by an insert that is rotationally received in a socket in the first section.

3. The guide assembly of claim 2, wherein the elongate body of the first section has a bore that passes through the body from a first end, remote from the second section, and into the socket, and wherein the fastener extends through the bore and into an aligned hole in the insert, to lock the first and second sections together.

4. The guide assembly of claim 2, wherein the insert includes an axle that passes through the socket to an underside of the elongate body and is held captive by a roller that is fitted onto the axle and allows for rolling movement of the first section along the channel.

5. The guide assembly of claim 4, wherein the first section has another axle adjacent the first end, depending from an underside of the elongate body, that supports a roller to facilitate rolling movement of the assembly in the channel.

6. The guide assembly of claim 1, wherein the bolt support portion includes a collar to receive an end of the bolt, the collar being positioned at a remote end of the arm.

7. The guide assembly of claim 6, wherein the collar has an asymmetric internal profile to fit with an external profile of the bolt and resist axial rotation of the bolt relative to the guide assembly.

8. The guide assembly of claim 7, wherein the collar includes a bore to receive a lug, to engage and lock the bolt in the bolt support portion.

9. The guide assembly of claim 1, wherein top surfaces of the first and second sections are in substantial alignment.

10. The guide assembly of claim 9, wherein the first section has left and right indication markings to identify the required position of the arm relative to the first section in order to adopt the left or right orientation.

* * * * *